US007266971B2

(12) United States Patent
Kang

(10) Patent No.: US 7,266,971 B2
(45) Date of Patent: Sep. 11, 2007

(54) AIR CONDITIONER

(75) Inventor: Dong Hoon Kang, Busan-si (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 11/079,184

(22) Filed: Mar. 15, 2005

(65) Prior Publication Data

US 2006/0032260 A1 Feb. 16, 2006

(30) Foreign Application Priority Data

Aug. 16, 2004 (KR) ..... P2004-0064424

(51) Int. Cl.
*F25D 17/04* (2006.01)
*B60H 23/00* (2006.01)

(52) U.S. Cl. ..... 62/317; 62/327

(58) Field of Classification Search ..... 62/126, 62/186, 187, 298, 317, 303, 419, 427; 165/96; 454/53, 286, 327, 333
See application file for complete search history.

(56) References Cited

U.S. PATENT DOCUMENTS 3,710,588 A * 1/1973 Martinez ..... 62/317
4,167,852 A * 9/1979 Ludecke ..... 60/296
4,526,227 A * 7/1985 Baker ..... 165/124
5,925,172 A * 7/1999 Rick et al. ..... 96/397
6,171,376 B1 * 1/2001 Hironaka et al. ..... 96/28
6,338,382 B1 * 1/2002 Takahashi et al. ..... 165/96
6,626,971 B1 * 9/2003 Forbert et al. ..... 55/385.2
6,804,975 B2 * 10/2004 Park ..... 62/324.1
6,916,240 B1 * 7/2005 Morton ..... 454/286

FOREIGN PATENT DOCUMENTS

CN 1232948 A 10/1999
JP 5-96121 A * 4/1993

* cited by examiner

*Primary Examiner*—Mohammad M. Ali
(74) *Attorney, Agent, or Firm*—Birch, Stewart, Kolasch & Birch, LLP

(57) ABSTRACT

Disclosed is an air conditioner having an excellent air cleaning function, the air conditioner including a cabinet having a first air inlet and discharging conditioned air; and a filter unit provided at the cabinet and cleaning air drawn therein, and selectively performing an interlocking operation for supplying purified air to the cabinet or an independent operation for discharging the purified air directly to the outside thereof.

19 Claims, 9 Drawing Sheets

AIR CONDITIONER

CROSS-REFERENCE TO RELATED APPLICATIONS

This application claims the benefit of Korean Application No. P2004-64424, filed on Aug. 16, 2004, which is hereby incorporated by reference as if fully set forth herein.

BACKGROUND OF THE INVENTION

1. Field of the Invention

The present invention relates to an air conditioner, and more particularly, to an air conditioner having an indoor unit provided in a room for cooing and heating a room.

2. Discussion of the Related Art

In general, an air conditioner is an apparatus for controlling temperature and humidity of air in a particular area according to a use. As an example of the air conditioner, there is an apparatus having a compressor and a heat exchanger for flowing refrigerant to cool or heat such an indoor space as a housing space, a dining room, a library, or an office.

Generally, the air conditioner is divided into an integrated type air conditioner and a separate type air conditioner. The integrated type air conditioner has an outdoor unit and an indoor unit, the units formed as a single body, has heating and cooling functions, and is directly mounted on a wall of a house by boring a hole or by hanging on a window.

Meanwhile, the separate type air conditioner includes the indoor unit having the heat exchanger for cooling or heating a room, and an outdoor unit, the outdoor unit including the heat exchanger for heat exchanging with outdoor air, and the compressor for compressing the refrigerant with a high pressure and discharging the refrigerant. In this case, the indoor unit and the outdoor unit are separately mounted at an inside and outside of the room, respectively, and connected with each other via a refrigerant pipe.

Hereinafter, the indoor unit of the separate type air conditioner in accordance with the related art is described referring to appended drawings. FIG. 1 is a perspective view showing an indoor unit of the separate type air conditioner in accordance with the related art, and FIG. 2 is a cross sectional view showing an indoor unit of the separate type air conditioner in accordance with the related art.

Referring to FIGS. 1 and 2, the indoor unit of the separate type air conditioner in accordance with the related art includes a cabinet 10, a heat exchanger 20, and a fan 30 provided at a lower part of the heat exchanger 20 and forcing air to flow.

In this case, a front air inlet (not shown) is provided on a front surface of the cabinet 10, a top air inlet (not shown) is provided on a top surface thereof, and an air outlet 11 is provided at a lower part thereof.

A front suction grill 12 and a top suction grill for ventilation are provided respectively at the front air inlet and the top air inlet. In this case, the top suction grill and the cabinet 10 are formed as a single body.

A front filter 14 for purifying the air drawn in through the front suction inlet is provided in the front suction grill 12. Meanwhile, the cabinet 10 includes a louver 15 for adjusting a left/right direction of the air discharged to the air outlet 11, and a vein 16 for adjusting an up/down direction of the air discharged to the air outlet 11.

The indoor unit of the air conditioner in accordance with the related art with the structure mentioned above draws air from outside of the cabinet 10 through the operation of the fan, i.e., from the room. The air drawn into the indoor unit is cooled or heated at the heat exchanger 20 and then discharged to the room so as to cool or heat the room.

In the indoor unit of the air conditioner in accordance with the related art, only the air drawn through the front grill 12 is purified by the front filter 14, and the air drawn through the lop air inlet is just discharged to the room without being purified, thereby causing a problem that the air cleaning fraction is insufficiently performed.

Furthermore, in case that a filter is separately provided for purifying the air drawn through the top air inlet, there are problems that a manufacturing cost is increased, and, due to the decrease of the spaces for mounting other elements such as the heat exchanger 20 and the fan 30 provided in the cabinet, that the heat exchanging function and the suction function are lowered.

In addition, since the whole indoor unit is operated for performing the air cleaning function, there is a problem of wasting energy.

SUMMARY OF THE INVENTION

Accordingly, the present invention is directed to an air conditioner that substantially obviates one or more problems due to limitations and disadvantages of the related art.

An object of the present invention is to provide an air conditioner having excellent air cleaning efficiency.

Another object of the present invention is to provide an air conditioner having improved air cleaning efficiency and increased freedom of installation.

Another object of the present invention is to provide an air conditioner having an indoor unit having a filter unit enabling to perform and interlocking operation for operating together with the indoor unit, and the an independent operation apart from the indoor unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner a includes an air conditioner comprising a cabinet having a first air inlet and discharging conditioned air; and a filter unit provided at the cabinet and cleaning air drawn therein, and selectively performing an interlocking operation for supplying purified air to the cabinet or an independent operation for discharging the purified air directly to the outside thereof.

The filter unit comprises a first filter for cleaning air drawn in through the operation of the fan; a filter case provided on the outside of the cabinet and having the first filter provided therein and discharging the air purified by the first filter; and a flow guiding member for guiding the air to flow, the air discharged from the filter case, so as to selectively perform an interlocking operation for supplying the purified air to the cabinet or an independent operation being driven apart from the cabinet.

The flow guiding member comprises a first air outlet provided on a first side of the filter case and communicating with the first air inlet of the cabinet so as to supply the purified air to the cabinet; a second air outlet provided on a second side of the filter case and discharging the purified air to a room; and an airflow controller for controlling air movement so as to selectively discharge the purified air to the first air outlet or to the second air outlet.

The filter unit further comprises a louver for opening/closing the second outlet and guiding the air discharged through the second air outlet to the room.

The airflow controller comprises a damper for selectively blocking the air flowing to the first air outlet and the second air outlet.

The damper has an end rotatably connected with the filter case and is rotated for selectively blocking the air that flows to the first air outlet and the second air outlet.

The filter case further comprises a rotation guide for guiding the rotation of the damper.

The rotation guide comprises a guide projection provided on a side of the damper; and a guide recess formed in an arc shape on an inner wall of the damper so as to guide the guide projection.

The filter case is detachably provided at the first air inlet of the cabinet.

The filter unit further comprises at least one of an electric dust filter, a hepa filter, a nano carbon filter, a nano copper filter, and a nano silver filter.

The cabinet further comprises a second air inlet and a second filter for cleaning the air drawn in through the second air inlet.

The first air inlet is provided on an upper surface of the cabinet and the second air inlet is provided on a front surface of the cabinet.

The cabinet further comprises a front panel for opening/closing the second air inlet. The cabinet further comprises a third air inlet.

In another aspect of the present invention, an air conditioner comprising a cabinet having a first air inlet and a second air inlet and discharging purified air; and a filter unit including a filter case having a first air outlet for discharging air to the first air inlet and a second air outlet for discharging air to a room, both formed therein and provided at an outside of the cabinet; a first filter accommodated in the filter case and cleaning the air drawn therein; and an airflow controller for controlling airflow so as to selectively discharge the air purified by the first filter to either the first air outlet or the second air outlet.

The airflow controller comprises a damper having an end rotatably provided at the filter case and selectively blocking the air flowing to the first air outlet or to the second air outlet.

The filter case further comprises a rotation guide for guiding the rotation of the damper.

The rotation guide comprises a guide projection provided at a side on an edge of the damper; and a guide recess formed in an arc shape on an inner wall of the filter case so as to guide the guide projection.

In this case, the first air inlet is provided on an upper surface of the cabinet and the second air inlet is provided on a front surface of the cabinet.

The cabinet further comprises a front panel being rotated for opening/closing the second air inlet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
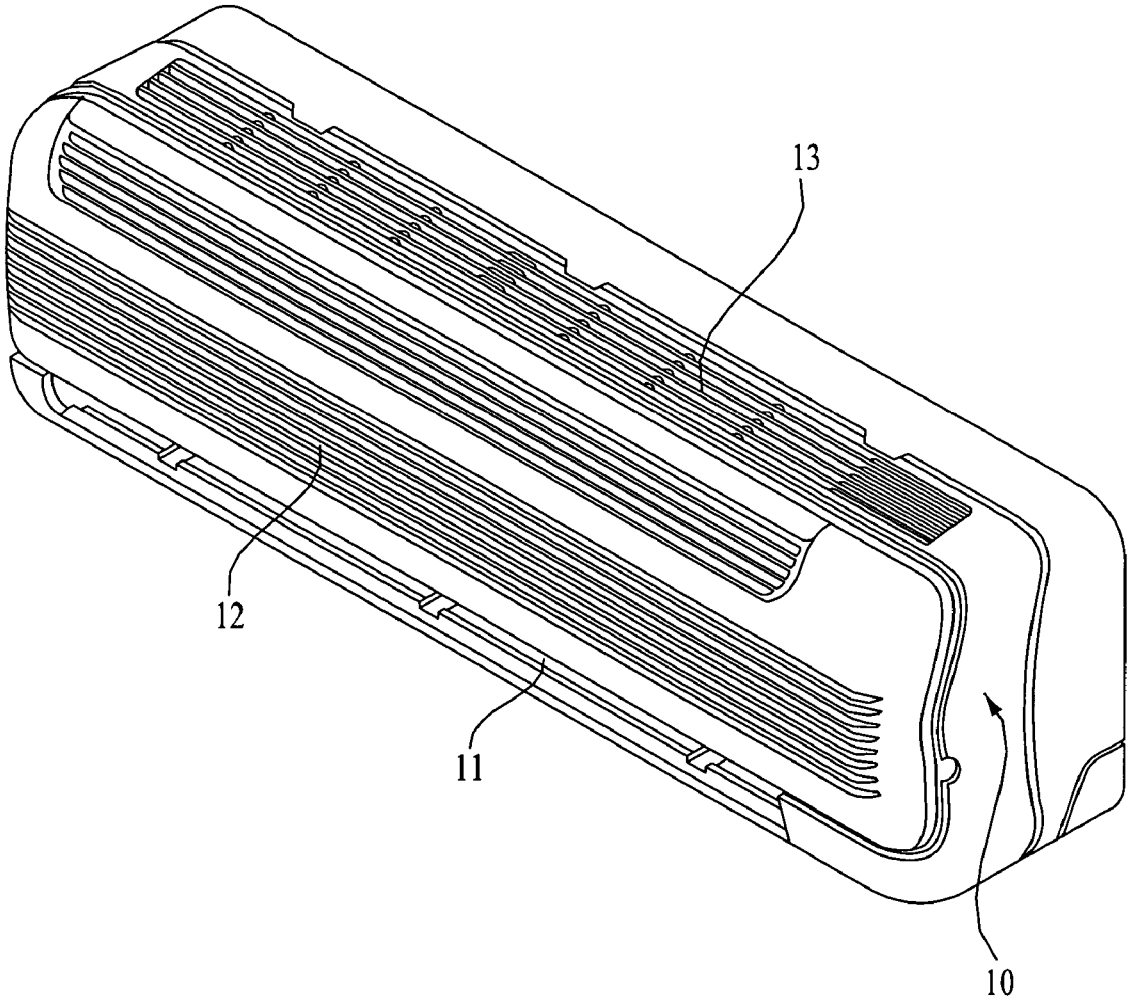
FIG. 1 illustrates a perspective view showing an indoor unit of a separate type air conditioner in accordance with a related art.
Figure 2:
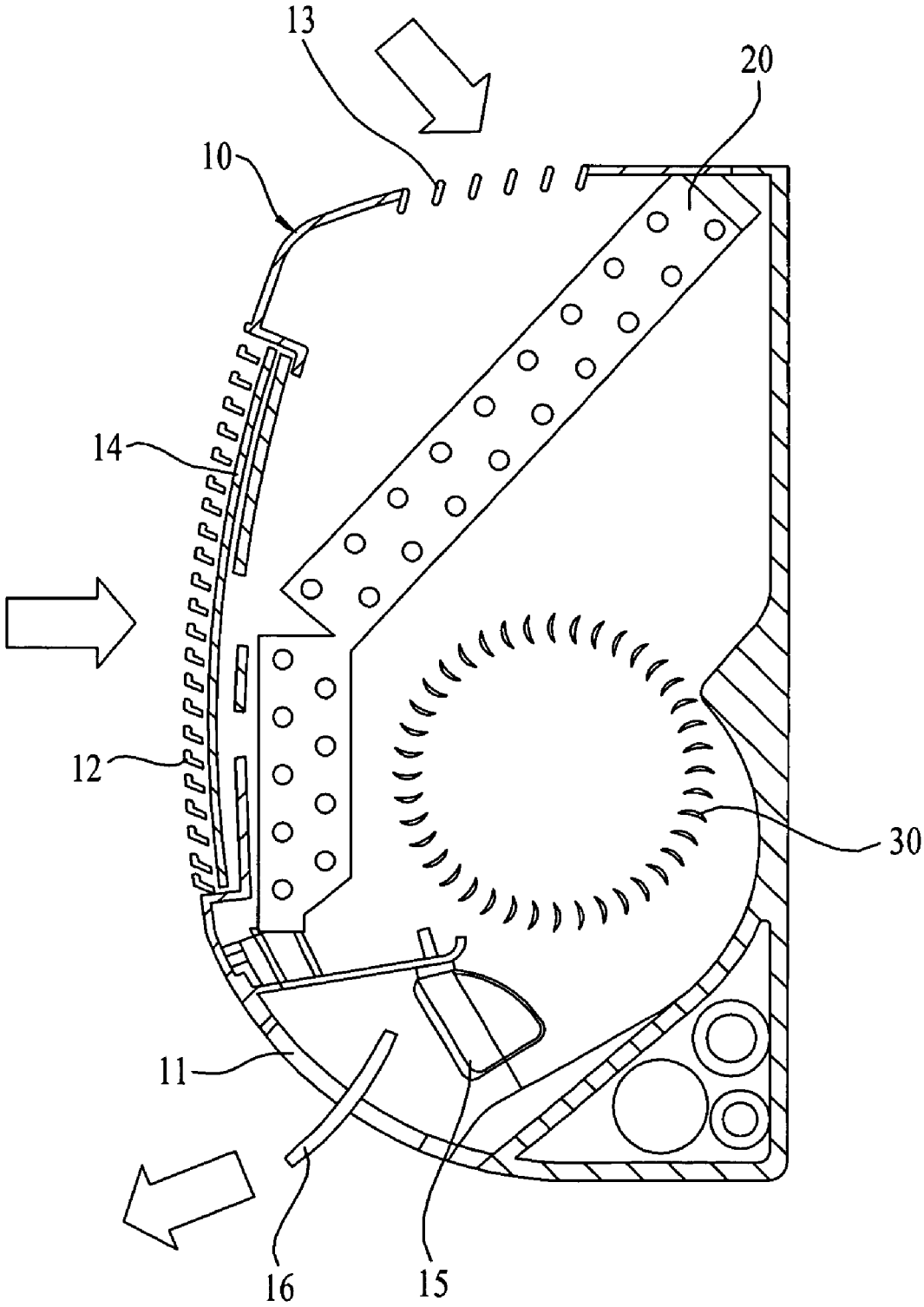
FIG. 2 illustrates a cross sectional view showing an indoor unit of a separate type air conditioner in accordance with a related art.
Figure 3:
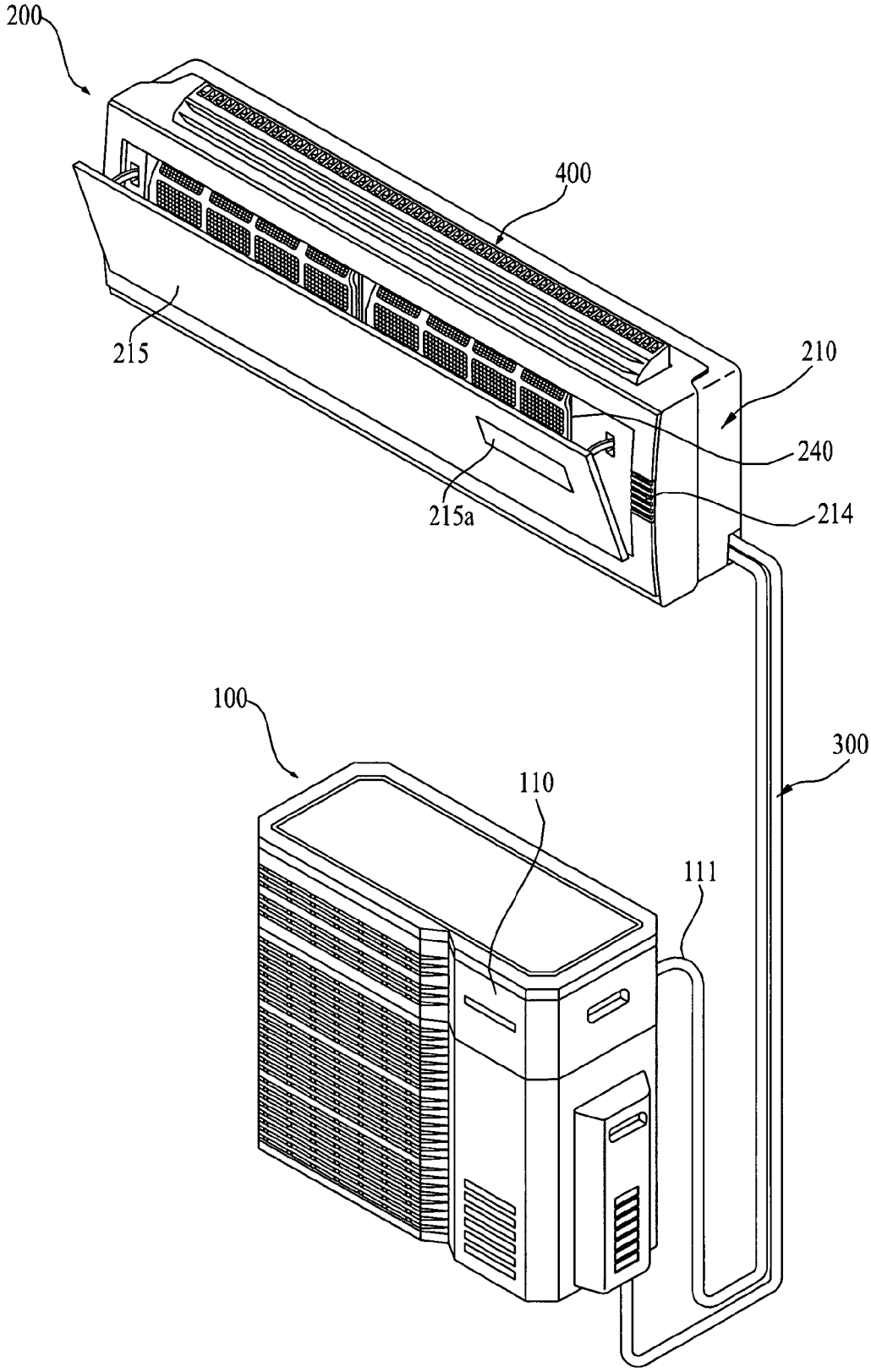
FIG. 3 illustrates a perspective view showing an air conditioner in accordance with the present invention in an operation state.
Figure 4:
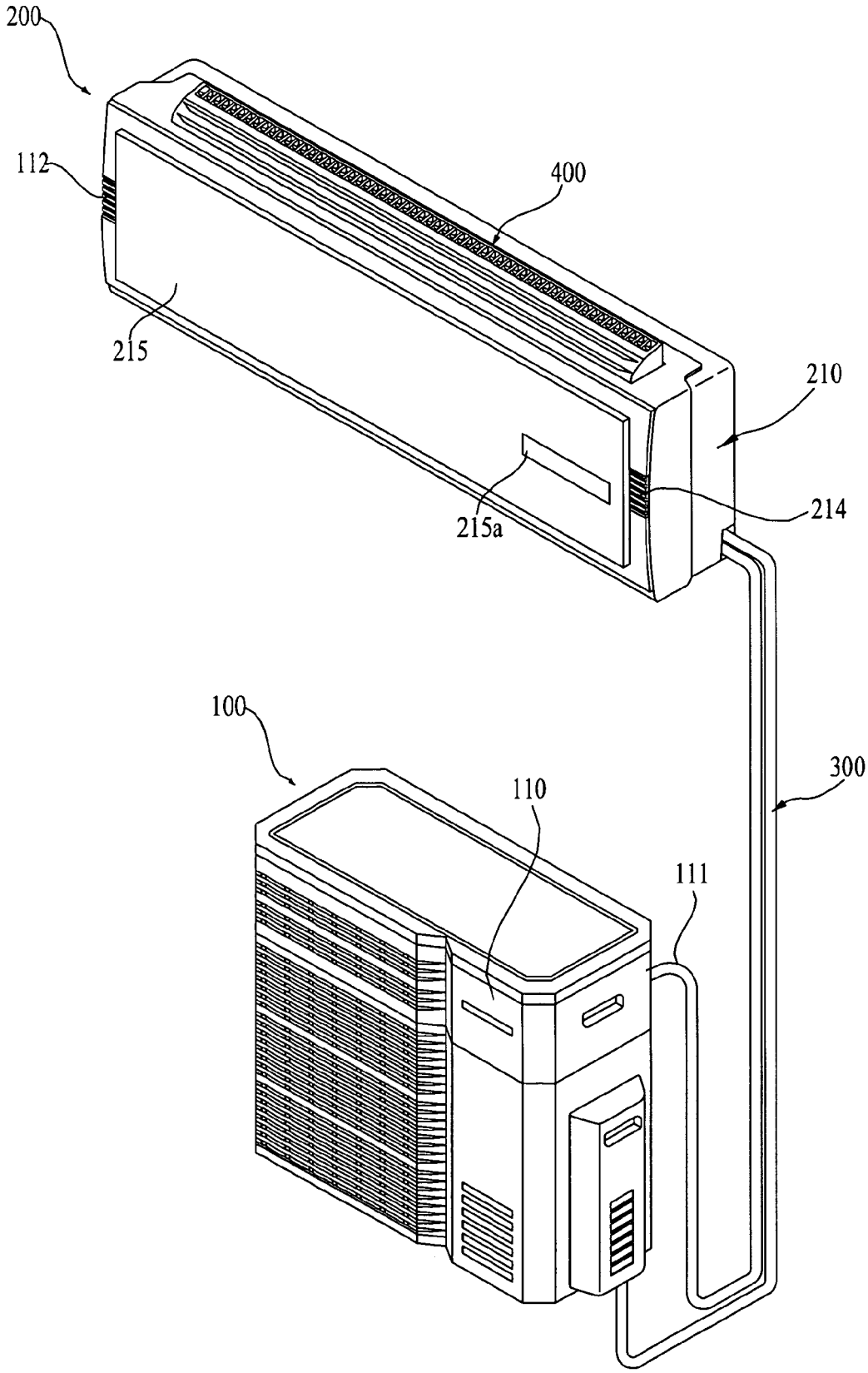
FIG. 4 illustrates a perspective view showing the air conditioner in accordance with the present invention in a stoppage state.
Figure 5:
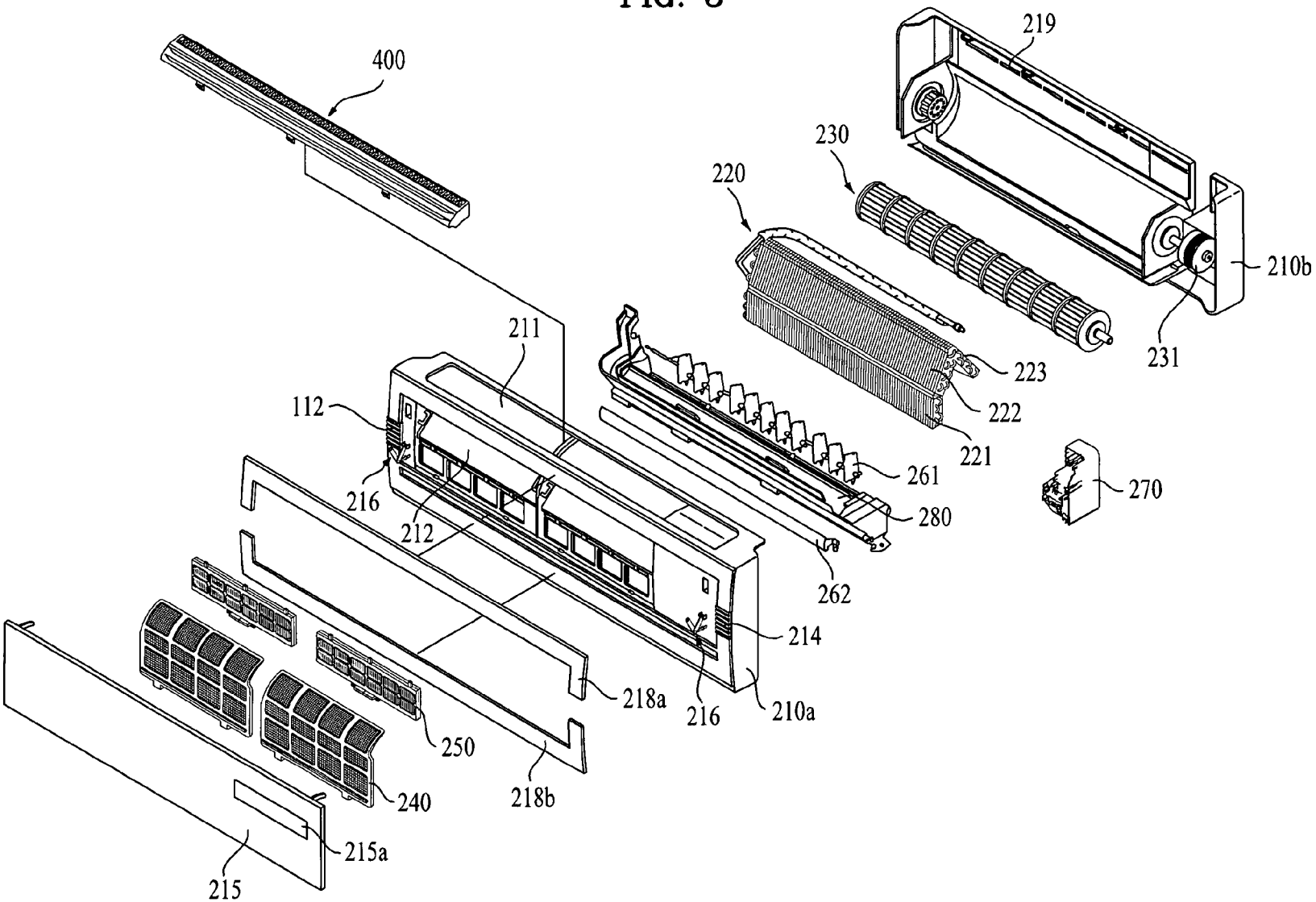
FIG. 5 illustrates an exploded perspective view showing the air conditioner in accordance with the present invention in the stoppage state.

FIG. 3 illustrates a perspective view showing an air conditioner in accordance with the present invention in an operation state, FIG. 4 illustrates a perspective view showing the air conditioner in accordance with the present invention in a stoppage state, and FIG. 5 illustrates an exploded perspective view showing the air conditioner in accordance with the present invention in the stoppage state.

Referring to FIGS. 3 to 5, the air conditioner in accordance with the present invention includes an outdoor unit 100 provided at outside of a room, an indoor unit 200 provided at inside of the room for cooling or heating the room, and a refrigerant pipe 300 for connecting the outdoor unit 100 and the indoor unit 200.

The outdoor unit 100 is provided with an outdoor heat exchanger (not shown) for exchanging heat with the outdoor air drawn into the outdoor unit, a compressor (not shown) compressing and discharging the refrigerant, and an expander (not shown) for expanding the refrigerant, all formed in the outdoor unit 100. In addition, an oxygen generator 110 or a humid air generator (not shown) is provided at a side of the outdoor unit 100.

The oxygen generator 110 being an apparatus for generating fresh oxygen is coupled with the indoor unit 200 and an oxygen supply pipe 111.

Accordingly, oxygen generated from the oxygen generator 110 is supplied to the indoor unit 200 through the oxygen supply pipe 111, and the oxygen supplied to the indoor unit 200 is supplied to the room through an oxygen discharge hole 112 formed at a side on the front side of the indoor unit 200.

In the following, referring to the appended drawings, a wall mounted indoor unit 200 among the separate type air conditioner will be described as a first embodiment of the indoor unit provided at the air conditioner in accordance with the present invention.

The indoor unit 200 includes a cabinet 210 having at least one air inlet, at least one air outlet, and a predetermined space therein, a fan 230 provided in the cabinet 210 and forcing air movement. The cabinet 210 includes a filter unit 400 enabling both to work together with the cabinet 210 and to independently work regardless of the cabinet 210.

A first air inlet 211 is formed on an upper surface of the cabinet 210 for drawing in the air from the outside of the cabinet 210, i.e., from the room, and a second air inlet 212 is formed on a front surface of the cabinet 210.

An air outlet 213 for discharging cooled or heated air is formed at a lower part of the cabinet 219. In this case, it is desirable that the air outlet 213 is formed at a lower surface of the cabinet 210 so as to discharge the air in a direct downward direction of the cabinet 210.

In more detail, the cabinet 210 includes a front cabinet 210*a* having an opened rear, and a rear cabinet 210*b* having an opened front.

In this case, the first air inlet is formed on a top surface of the front cabinet 210*a*, the second air inlet 212 is formed on a front surface of the front cabinet 210*a*, and the air outlet 213 is formed at a bottom surface of the front cabinet.

The oxygen outlet hole 112 is formed on a left side of a front edge of the front cabinet 210*a*, and an operation controller 214 is mounted on a right side of the front edge thereof, the operation controller 214 for controlling the operation of the indoor unit 200 and displaying operation information of the air conditioner. Positions of the oxygen discharge hole 112 and the operation controller 214 can be changed to each other.

In the case, the operation controller 214 includes a printed circuit substrate, a plurality of LEDs soldered in the printed circuit substrate, and a diffusion board provided in front of the LEDs and diffusing the light of the LEDs. A switch (not shown) being in contact with the printed circuit substrate is provided in the rear of the operation controller 214 so as to input the operation information of the air conditioner.

A front filter 240 for filtering impurities contained in the air drawn through the second air inlet 212 is provided in front of the front cabinet 210*a*, and an electric dust collector 250 for ionizing and collecting impurities contained in the air drawn in through the second air inlet 212 is provided in the rear of the front filter 240.

A front panel 215 for opening/closing the second inlet 212 is provided on a front surface of the front cabinet 210*a*, and a display 215*a* is provided on a side of the front surface of the front panel 215, the display 215*a* including an LCD or LED for displaying the operation information of the air conditioner.

In this case, a mirror, a color panel or a frame may be provided on a front surface of the front panel 215. The front panel 215 is rotatably provided so as to be rotated in a forward direction around a lower part of the front panel and to open or close the second air inlet 212 according to whether the indoor unit is operated.

In other words, the front panel 215 is configured to open the second air inlet 212 during the operation of the indoor unit 200 and to close the second inlet 212 during the stoppage thereof.

For this reason, the front panel 215 is connected to the front cabinet via a link member 216. The link member 216 includes a first link 216*a* rotatably provided at a front lower part of the front cabinet 210*a*, and a second link 216*b* having a first end rotatably connected to a second end of the first link member 216*a* and second end rotatably provided at a rear lower part of the front panel 215.

In this case, a first end of the first link 216*a* is hinge coupled with the front cabinet 210*a*, and the second end of the first link 216*a* is declined and extended downward. A fixing member 216*c* for selectively fixing the second end of the first link 216*a* is protruded from a lower part of the first end of the first link 216*a* so as to selectively fix the second end of the first link 216*a*.

In other words, the fixing member 216*c* fixes the second end of the first link 216*a* when the front panel 215 is rotated for opening/closing the second air inlet 212.

When the front filter 240 is placed or displaced, the front panel 215 is released from the second end of the first link 216*a* such that the front panel 215 is completely opened and the front filter 240 is placed at a lower front part of the front cabinet 210*a*.

A pinion 217*a* for rotating the front panel 215 is provided at an upper part of the front cabinet 210*a*, and a rack 217*b* meshed with the pinion 217*a* is protruded from the rear of the front panel 215 at an upper rear part of the front panel 215. In this case, it is desirable that the pinion 217*a* is rotated by a motor, and the rack 217*b* is formed in an arc.

In addition to the structure aforementioned, on a front edge of the front cabinet 210*a* except a portion having the oxygen discharge hole 112 and the operation controller 214 formed thereon, an upper ornamental panel 218*a* and a lower ornamental panel 218*b* are provided.

It is desirable that a third air inlet 219 is provided on an upper rear part of the rear cabinet 210*b* so as to minimize the air suction resistance.

At least one louver 261 for controlling the air discharged through the air outlet 213 in a left/right direction is rotatably provided at an inner lower part of the front cabinet 210*a*, and a vein 262 for controlling the air discharged through the air outlet 213 in an up/down direction is rotatably provided at the air outlet 213.

The fan 230 forces air movement such that air is drawn through the first air inlet 211 and the second air inlet 212 of the front cabinet 210*a* and through the third air inlet 219, heat exchange is occurred therebetween, and then the air is discharged to the room through the air outlet 213.

In this case, the fan 230 including a cross flow fan driven by a motor 231 is provided to be long in a row inside of the rear cabinet 210*b*, and a control box 270 for controlling the operation of the air conditioner in accordance with the present invention is provided on a front side of the motor 231 for rotating the fan 230.

The indoor heat exchanger 220 provided between the air inlets 211, 212, and 219 and the fan 230 performs a cooling/heating the air drawn in through the air inlets 211, 212, and 219.

The indoor heat exchanger 220 includes a vertical member 221 vertically provided at the rear of the second air inlet 212, a first sloping member 222 inclined rearward from a top end of the vertical member 221, and a second sloping member 223 declined rearward from a top end of the first sloping member 222.

In this case, the vertical member 221 exchanges heat mainly with the air drawn in from the second air inlet 212, the first sloping member 222 exchanges heat with the air drawn in from the first air inlet 211 and the second sloping member 223 exchanges heat with the air drawn in from the third air inlet 219.

A condensed water reservoir 280 for reserving the condensed water dropped from the indoor heat exchanger 400 is provided at the inner lower part of the front cabinet 210*a*, preferably at a lower part of the vertical member 221 of the heat exchanger 400.

Meanwhile, the filter unit 400 is provided on an upper surface of the cabinet so as to supply purified air to the cabinet 210 and the room. In this case, the filter unit 400 selectively supplies the purified air either to the cabinet or to the room, or of course may provide to both the cabinet and the room at the same time.

In other words, the filter unit 400 enables both an interlocking operation for supplying the purified air to the cabinet 210 and an independent operation for supplying the purified air only to the room without supplying to the cabinet 210.

Figure 6:
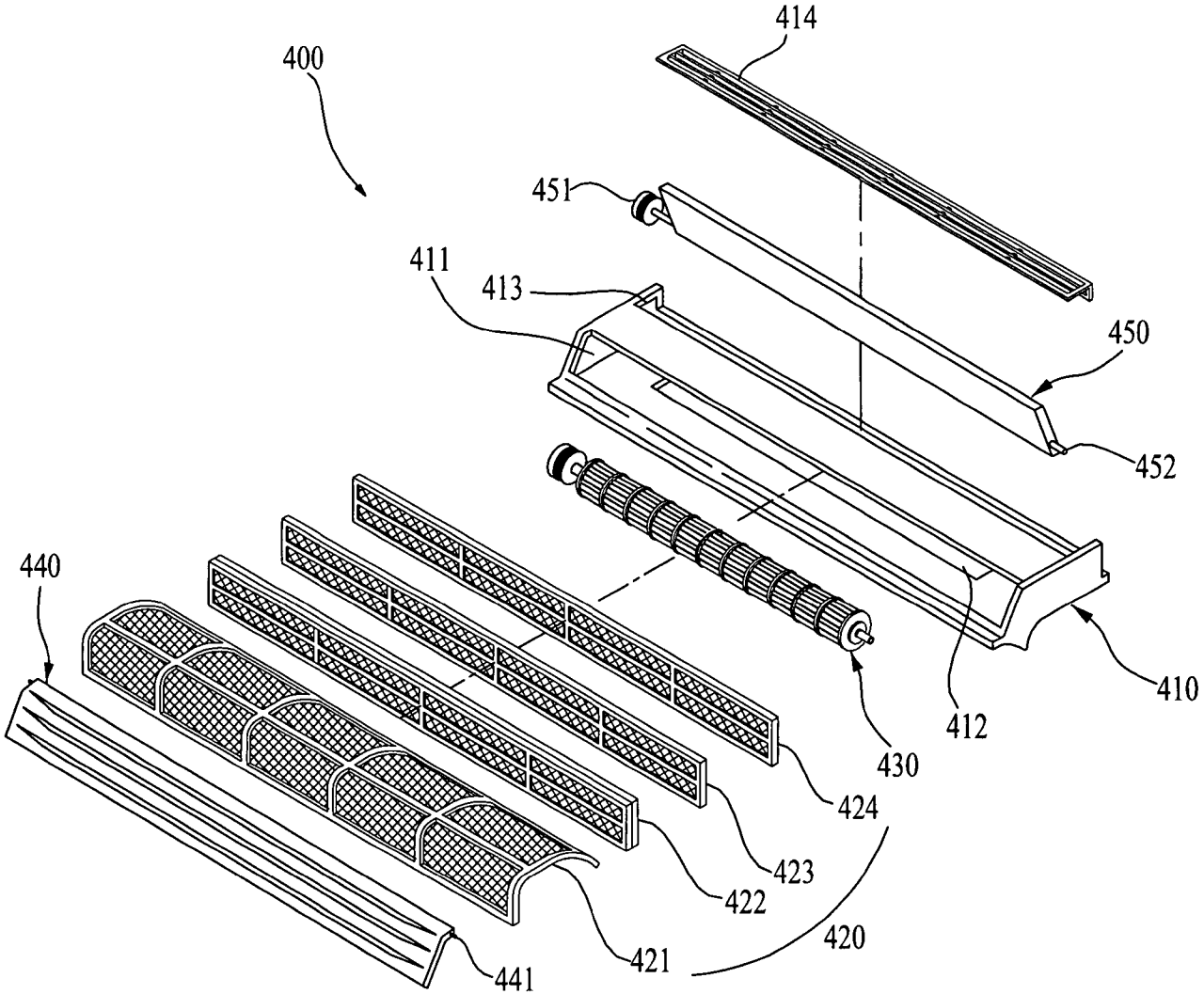
FIG. 6 illustrates an exploded perspective view schematically showing a filter unit provided at an indoor unit of the air conditioner in accordance with a first embodiment of the present invention.
Figure 7:
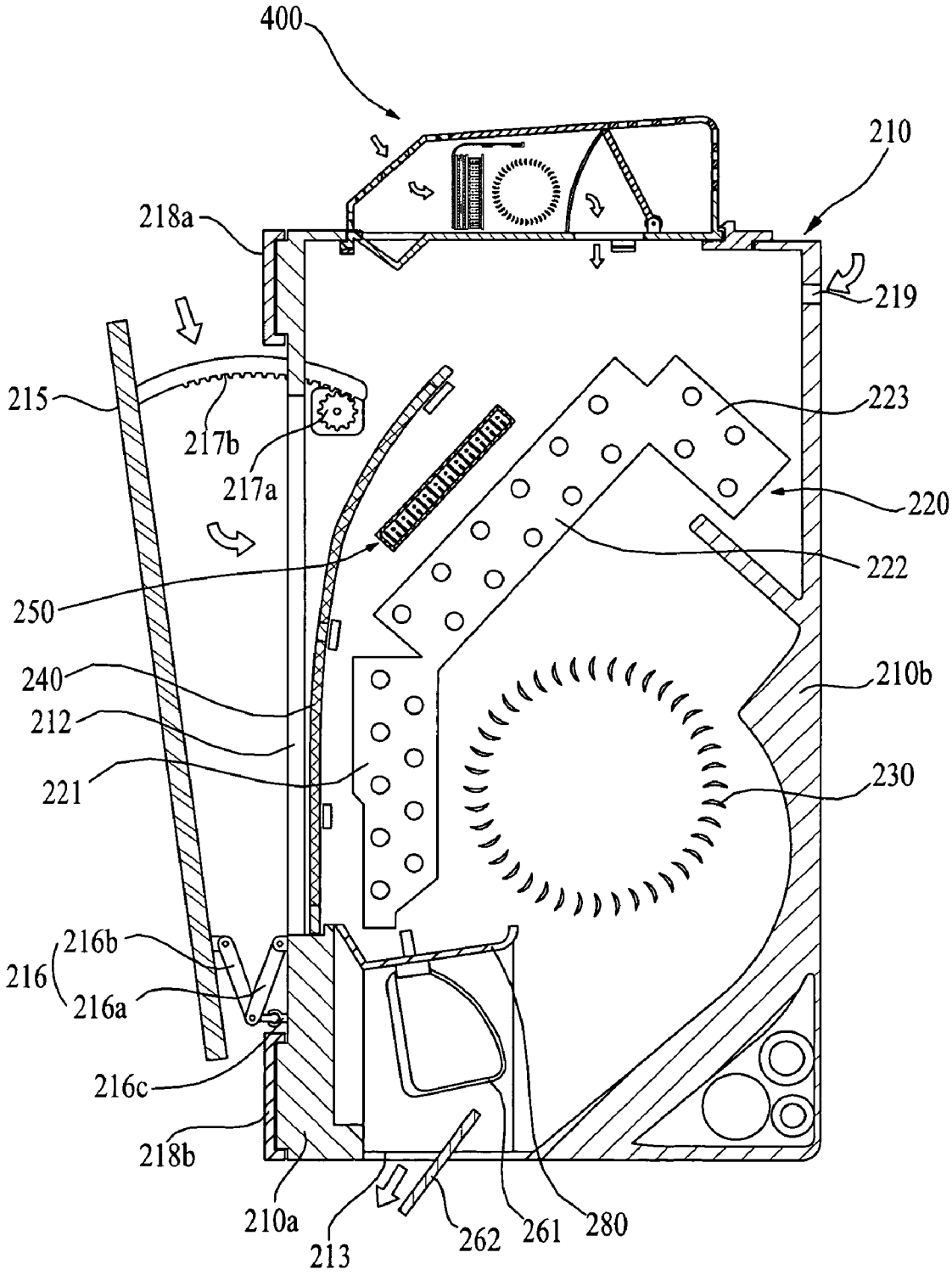
FIG. 7 illustrates a cross sectional view showing the indoor unit provided at the air conditioner in accordance with the first embodiment of the present invention.
Figure 8:
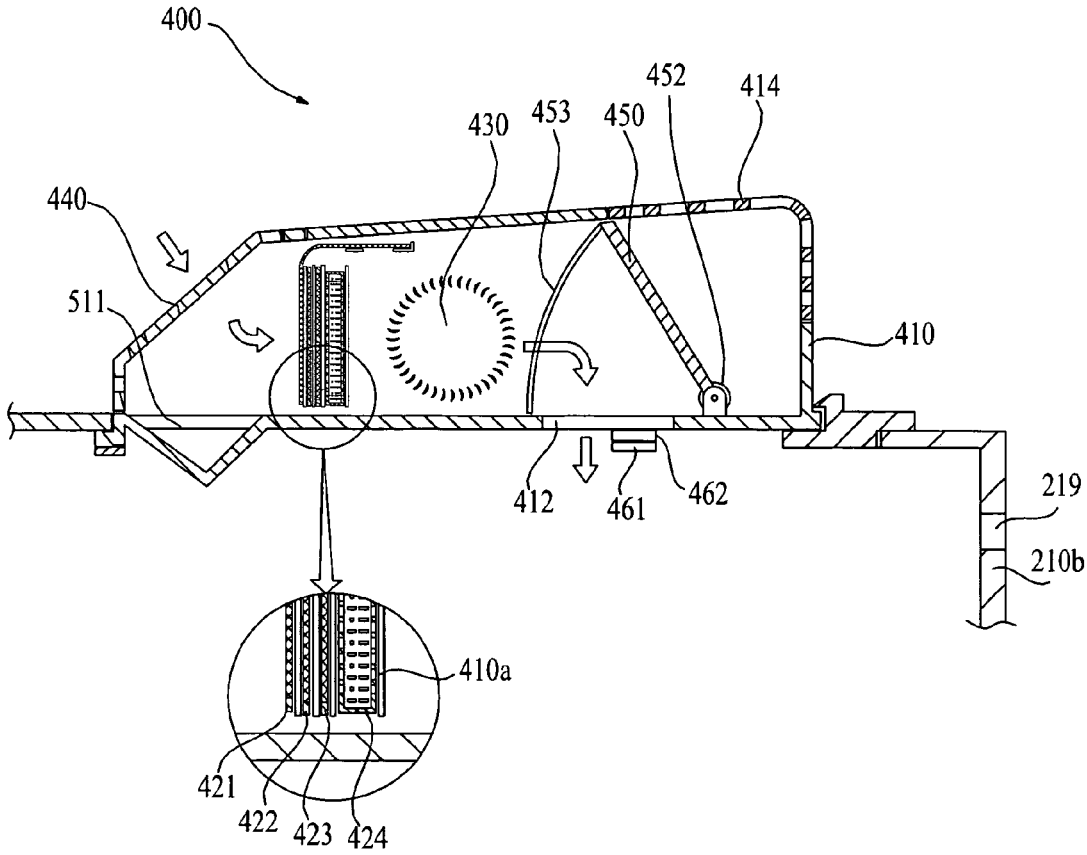
FIG. 8 illustrates a cross sectional view showing a state that the filter unit provided at the indoor unit of the air conditioner in accordance with the first embodiment of the present invention is engaged with the cabinet of the indoor unit.
Figure 9:
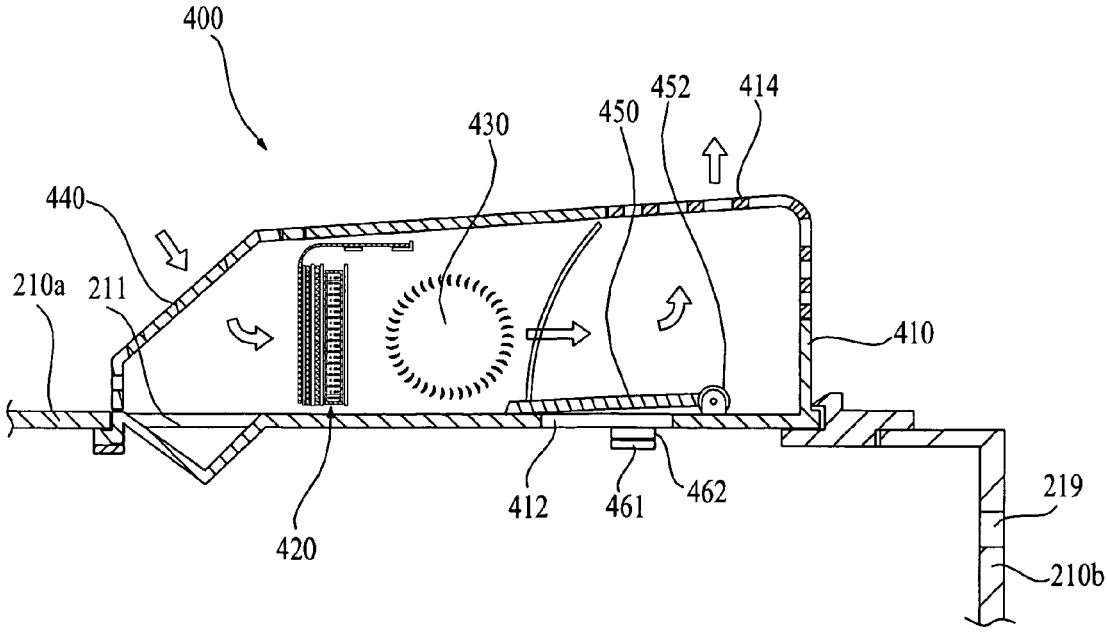
FIG. 9 illustrates a cross sectional view showing a state that the filter unit provided at the indoor unit of the air conditioner in accordance with the first embodiment of the present invention is independently operated.

FIG. 5 illustrates an exploded perspective view showing the air conditioner in accordance with the present invention in the stoppage state. FIG. 6 illustrates an exploded perspective view schematically showing a filter unit provided at an indoor unit of the air conditioner in accordance with a first embodiment of the present invention. FIG. 7 illustrates a cross sectional view showing the indoor unit provided at the air conditioner in accordance with the first embodiment of the present invention. FIG. 8 illustrates a cross sectional view showing a state that the filter unit provided at the indoor unit of the air conditioner in accordance with the first embodiment of the present invention is engaged with the cabinet of the indoor unit. FIG. 9 illustrates a cross sectional view showing the filter unit being separately operated, the filter unit provided at the indoor unit of the air conditioner in accordance with the first embodiment of the present invention.

Referring to FIG. 5 to FIG. 9, the filter unit 400 includes a filter case 410 provided at an outside thereof, particularly on a top surface of the cabinet, a filter member 420 provided in the filter case 410 and cleaning the air, and a flow guiding member for selectively guiding the air purified by the filter member 420 and selectively supplying the purified air either the cabinet 210 or the room.

It is desirable that the filter case 410 is detachably provided over the first air inlet 211. An air inlet 411 is provided at a front portion of the filter case 410, the air inlet 411 through which outside air, i.e., room air is drawn in through the operation of the fan 430 provided in the filter case.

It is desirable that a front grill 440 enabling to ventilate air is provided at the air inlet 411 of the filter case 410. In this case, a top end of the front grill 440 is rotatably connected with inner upper ends of both sides of the air inlet 411. For this reason, a rotation pivot 441 is protruded respectively from both sides of the top end of the front grill 440, and a hole (not shown) is provided at both upper ends of the air inlet 411, the hole to which each of the rotation pivot 441 is rotatably inserted.

In the filter case 410, a plurality filter supporting ribs 410*a* for supporting the filter member 420 and guiding the entrance and exit of the filter member 420 at the same time.

In the present invention, since the filter member 420 is vertically provided in an up/down direction, the plurality of filter supporting ribs 410*a* are formed to be long in the up/down direction respectively on both sides of the filter case 410.

The filter unit 420 includes at least one filter. In more detail, the filter unit 420 includes a first filter 421 provided at the rear of the air inlet 411, a nano copper filter 422 provided at the rear of the air inlet 411, a nano silver filter 423 provided at the rear of the nano copper filter 422, and an electric dust collector 424 provided at the rear of the nano silver filter 423.

The filter unit 420 may further include a nano carbon filter and a heap filter, and the order in which the filters are arranged is not limited to that mentioned above.

A fan 430 for forcing the air movement is provided at the rear of the filter unit 420 so as to be rotated by the motor for the filter unit (not shown). In the present invention, the fan 430 is, but not limited to, the cross flow fan.

Meanwhile, the flow guiding member includes a first air outlet 412 provided at a side of the filter case 410, a second outlet provided at a second side of the filter case 410, and an airflow controller for controlling airflow to selectively discharge the air purified by the filter member 420 to the first air outlet 412 or the second air outlet 413.

In this case, the first air outlet 412 is provided on a bottom surface of the cabinet and communicated with the first air inlet 211 of the cabinet so as to supply the purified air to the cabinet 210.

The second air outlet 413 is provided at an upper rear portion of the filter case 410 so as to discharge the air directly to the room, and an upper grill 414 capable of ventilation is provided at the second air outlet.

The airflow controller includes a damper 450 for selectively blocking the air flowing to the first air outlet 412 and the second air outlet 413 of the filter case 410. In other words, the damper 450 is configured to discharge the air purified by the filter member 420 to either the first air outlet 412 or the second outlet 413.

In this case, the damper 450 having a first end rotatably connected to the filter case 410 is rotated by a damper motor 451 so as to selectively block the air flowing to the first air outlet 412 and the second outlet 413.

In more detail, the first end of the damper 450 is rotatably coupled to the bottom of the filter case, particularly to a side of the edge of the first air outlet 412 via a hinge 452.

Accordingly, the damper 450 is configured to open/close the first air outlet 412 via the damper motor 451 as well as to block the air flowing to the second air outlet 413 when a second end of the damper 450 is rotated in an upper direction and closely adhered to an upper inner wall of the filter case.

When the damper 450 is positioned at a location where neither the first air outlet 412 nor the second air outlet 413 is blocked by the damper 450, the filter unit 400 enables to perform an interlocking operation, thereby discharging the purified air to both the first air outlet 412 and the second outlet 413.

In addition to the aforementioned structural elements, the filter case 410 further includes a rotation guide 453 for guiding the rotation of the damper 450. In this case, the rotation guide 453 includes a guide rib protruded from both inner sides of the filter case 410 so as to guide the damper to a rotation track, the damper rotated by the damper motor 451.

The rotation guide 453 may include a guide projection (not shown) provided on a side of the second end of the damper 450 and a guide recess (not shown) formed in an arc shape and provided on an inner wall of the filter ease 410 so as to guide the guide projection.

Although the airflow controller introduces the damper 450 rotated for blocking the first air outlet 412 and the second air outlet 413 in the embodiment of the present invention, the airflow controller may also include two switching plates (not shown) for opening/closing the first air outlet 412 and the second air outlet 413, respectively. The airflow controller however is not limited to the damper or the opening/closing substrate.

In the mean time, a power source supplying substrate 461 is provided for supplying the electric power to the cabinet 424 or the damper motor 451, so as to supply electric power to the filter unit 400. The filter 410 is provided with a power source applying substrate 462 being in contact with the power source supplying substrate 461 during the installation of the filter unit 400.

The function of the separate type air conditioner in accordance with the present invention is described referring to FIGS. 7 to 9 as follows. First of all, with reference to FIGS. 7 and 9, a process is described in which the filter unit 400 works together with the cabinet 210 and thereby performs both the cooling/heating function and air cleaning function.

When the electric power is supplied to the air conditioner and the air conditioner starts to operate, the front panel 215 of the cabinet is rotated frontward to open the second air outlet 212 of the cabinet, and the vein 262 of the cabinet opens the air outlet 213 of the cabinet. The damper 450 of the filter unit is rotated upward to open the first air outlet 412.

In this instance, when the damper 450 completely blocks a passage through which the air passes to the second air outlet 413, all the purified air is supplied to the cabinet 210, and when the damper 450 partially blocks the passage through which the air passes to the second air outlet 413, the purified air is supplied to both the cabinet 210 and the room.

Hereinafter, the interlocking operation of the state that the damper 450 completely blocks the passage through which the air passes to the second air outlet 413 will be described.

When the second air inlet 212 of the cabinet and the first air outlet 412 of the filter unit are opened, the fan 230 of the cabinet and the fan 430 of the filter unit are rotated, and the compressor of the outdoor unit 100 is driven. Therefore, the refrigerant is circulated.

Accordingly, the room air is drawn into the cabinet through the second air inlet 212 and the third air inlet 219 of the cabinet and simultaneously to the filter case 410 through the front grill provided at the air inlet of the filter unit 400.

The air drawn into the cabinet through the second air inlet 212 and the third air inlet 219 is cooled/heated by the indoor heat exchanger 400 and discharged to the room thorough the air outlet 213 of the cabinet. In the process of discharging the air, the direction of the air discharged to the room is controlled by the louver 261 and the vein 262.

Meanwhile, the room air drawn into the filter unit 400 is purified by the filter unit 420, and supplied to the cabinet through the first air outlet 412 and the first air inlet 211.

The purified air supplied to the cabinet 210 through the fist air inlet 211 is cooled/heated at the heat exchanger 220 and then discharged to the room through the air outlet 213.

In a more detailed description of the air cleaning function through the filter member 420 of the filter unit, the room air drawn into the filter case 410 passes through the first filter 421, the nano copper filter 422, the nano silver filter 423, and the electric dust collector 424 in order, impurities such as dust contained in the room air is filtered and sterilized, and microscopic dust particles are ionized and collected.

In the interlocking operation, even if the fan 430 of the filter unit is not operated, the air cleaning function and the cooling/heating function are performed by the operation of the fan 230 of the cabinet.

When the fan 430 of the filter unit is operated together with the fan 230 of the cabinet, the amount of the air drawn into the filter unit 400 is increased and thus the air cleaning function is smoothly performed.

In the following, the independent operation of the filter unit 400 is described referring to FIG. 9. The independent operation of the filter unit includes a first independent operation mode in which the filter unit 400 and the cabinet 210 of the indoor unit separately draws in and discharges the room air, and a second independent operation mode in which only the filter unit 400 is driven and performing the air cleaning function.

Firstly, a case that the air conditioner is operated in the first independent operation mode is described as follows. In the first independent operation mode, the first air outlet 412 of the filter unit is completely blocked by the damper 450 of the filter unit, and the passage to the second air outlet 413 is completely opened.

Accordingly, the room air drawn into the filter case 410 through the fan 430 of the filter unit is purified by the filter member 420 and then directly supplied to the room through the top grill 414 of the second outlet 413.

Other structural elements of the air conditioner of the present invention are operated in the same way as described in the description of the interlocking operation of the filer unit 400, thereby a description of which is omitted hereinafter. In other words, in accordance with the present mode, the filter unit 400 is independently operated regardless of the cooling/heating functions of the cabinet, thereby purifying the room air.

In the following, a case that the air conditioner is operated in the second independent operation mode is described. In the second independent operation mode, only the filter unit 400 is independently operated, thereby performing the air cleaning function for cleaning the room air.

Therefore, the second independent operation mode means that the power is supplied only to the filter unit 400, thus the cooling/heating function of the cabinet is not performed.

In other words, the operation of the fan 230 provided at the indoor unit 200 of the air conditioner and the compressor provided at the indoor unit 100 is stopped, and thus the second air inlet 212 of the cabinet and the air outlet of the cabinet are closely shut by the front panel 215 and the vein 262, respectively.

The filter unit 400 is operated in the same way as in the first independent operation mode, therefore a description of which will be omitted hereunder.

In the following, referring to FIG. 10 and FIG. 11, a second embodiment of the filter unit provided at the air conditioner in accordance with the present invention is described.

Figure 10:
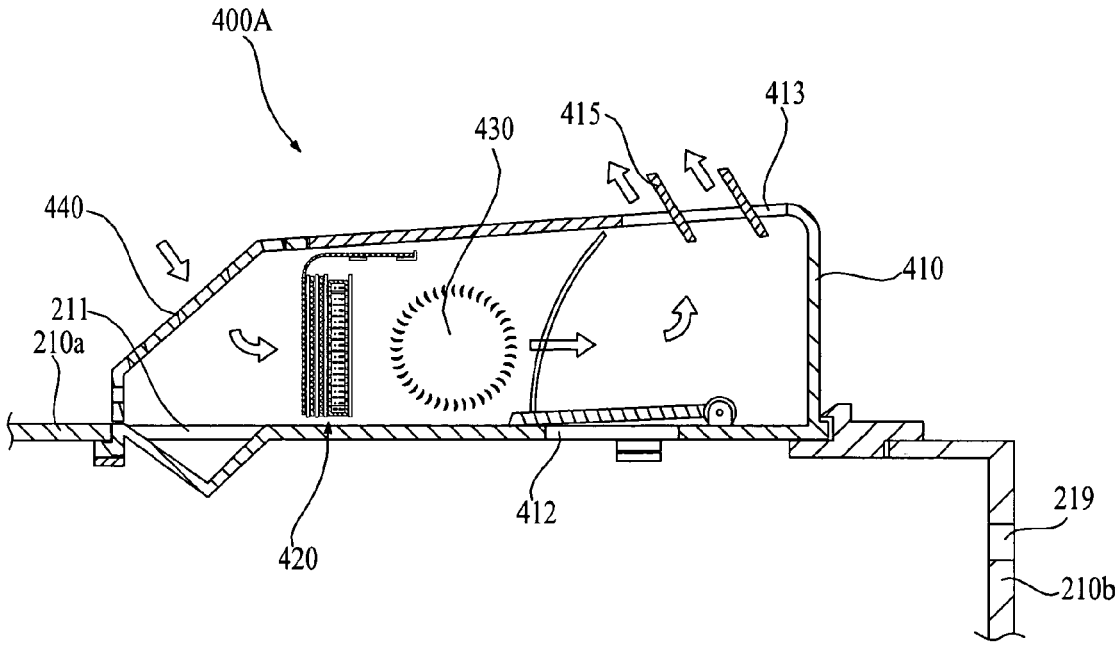
FIG. 10 illustrates a cross sectional view showing a filter unit provided at an indoor unit of the air conditioner in accordance with the second embodiment of the present invention.
Figure 11:
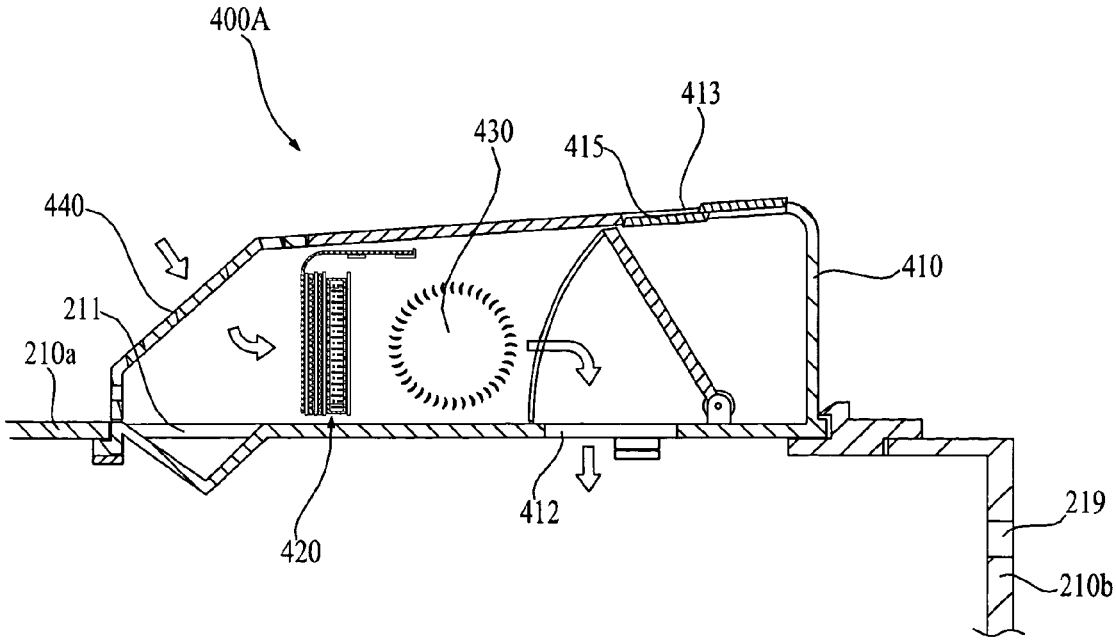
FIG. 11 illustrates a cross sectional view showing a state that the filter unit provided at the indoor unit of the air conditioner in accordance with the second embodiment of the present invention is engaged with the cabinet of the indoor unit.

In this case, FIG. 10 illustrates a cross sectional view showing the filter unit provided at an indoor unit of the air conditioner in accordance with the second embodiment of the present invention, and FIG. 11 illustrates a cross sectional view showing a state that the filter unit provided at the indoor unit of the air conditioner in accordance with the second embodiment of the present invention is engaged with the cabinet of the indoor unit.

In a description of the second embodiment of the filter unit provided at the indoor unit of the air conditioner in accordance with the present invention, the same number is used for the same structure in the first embodiment of the filter unit provided in the indoor unit of the air conditioner in accordance with the present invention, thereby the description of which will be omitted.

In other words, in the present embodiment, the second air outlet 413 is provided with a louver 415 opened/closed by the rotation of the second air outlet 413 instead of the top grill 414 introduced in the first embodiment of the filter unit aforementioned.

The louver 415 of the filter unit is opened/closed by the rotation of the second air outlet 413 so as to guide the room air discharged through the second air outlet 413.

In other words, the louver 415 of the filter unit not only controls the direction of the purified air discharged to the room though the second air outlet 413 but also prevents the impurities from being flown into the filter case 410 by closing the second air outlet 413 when the air conditioner is stopped for a long time.

The effect of the air conditioner in accordance with the present invention including the aforementioned structural elements is summarized as follows.

First, according to the air conditioner in accordance with the present invention, a filter unit is provided at an upper part of the cabinet, thereby increasing air cleaning efficiency.

Second, according to the air conditioner in accordance with the present invention, since the filter unit for performing the air cleaning function is detachably provided at the outside of the cabinet, together with the improvement of the air purifying efficiency, freedom of installation of the indoor heat exchanger and the fan is also increased. Therefore, the volume of an indoor heat exchanger and the fan is maximized.

Third, according to the air conditioner in accordance with the present invention, since the filter unit is operated in an interlocking operation in which purified air is supplied to the cabinet, or operated in an independent operation regardless of the cabinet, condition for operating the air conditioner is freely selected according to a environmental condition of a room.

Fourth, according to the air conditioner in accordance with the present invention, there is no need to mount a separate air cleaner, thereby decreasing a manufacturing cost.

Fifth, according to the air conditioner in accordance with the present invention, when only the air cleaning function is performed, only the fan is operated without operating the whole air conditioner, thereby decreasing energy.

Sixth, according to the air conditioner in accordance with the present invention, since a separate fan is provided at the filter unit, air suction force is increased while a fan motor built in the cabinet is prevented from being overloaded.

Seventh, according to the air conditioner in accordance with the present invention, since the interlocking operation and the independent operation of the filter unit are controlled by a damper, the filter unit has a simple structure and easy to operate.

Eighth, according to the air conditioner in accordance with the present invention, the filter member of the filter unit is provided with an electric dust collector, a heap filter, a nano carbon filter, a nano copper filter, and a nano silver filter, thereby increasing air cleaning function.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

a cabinet having a first air inlet and discharging conditioned air; and a filter unit detachably provided on the outside of the cabinet at the first air inlet, the filter unit cleaning air drawn therein, and selectively performing an interlocking operation for supplying purified air to the cabinet or an independent operation for discharging the purified air directly to the outside thereof.

2. The air conditioner of claim 1, wherein the filter unit comprises:

a first filter for cleaning air drawn in though the operation of a fan;

a filter case provided on the outside of the cabinet and having the first filter provided therein and discharging the air purified by the first filter; and a flow guiding member for guiding the air to flow, the air discharged from the filter case, so as to selectively perform an interlocking operation for supplying the purified air to the cabinet or an independent operation being driven apart from the cabinet.

3. The air conditioner of claim 2, wherein the flow guiding member comprises:

a first air outlet provided on a first side of the filter case and communicating with the first air inlet of the cabinet so as to supply the purified air to the cabinet;

a second air outlet provided on a second side of the filter case and discharging the purified air to a room; and an airflow controller for controlling air movement so as to selectively discharge the purified air to the first air outlet or to the second air outlet.

4. The air conditioner of claim 3, wherein the filter unit further comprises a louver for opening/closing the second outlet and guiding the air discharged through the second air outlet to the room.

5. The air conditioner of claim 3, wherein the airflow controller comprises a damper for selectively blocking the air flowing to the first air outlet and the second air outlet.

6. The air conditioner of claim 5, wherein the damper has an end rotatably connected with the filter case and is rotated for selectively blocking the air flowing to the first air outlet and the second air outlet.

7. The air conditioner of claim 6, wherein the filter case further comprises a rotation guide for guiding the rotation of the damper.

8. The air conditioner of claim 7, wherein the rotation guide comprises:

a guide projection provided on a side of the damper; and a guide recess formed in an arc shape on an inner wall of the damper so as to guide the guide projection.

9. The air conditioner of claim 2, wherein the filter unit further comprises at least one of an electric dust filter, a hepa filter, a nano carbon filter, a nano copper filter, and a nano silver filter.

10. The air conditioner of claim 1, wherein the cabinet further comprises a second air inlet.

11. The air conditioner of claim 10, wherein the first air inlet is provided on an upper surface of the cabinet and the second air inlet is provided on a front surface of the cabinet.

12. The air conditioner of claim 11, wherein the cabinet further comprises a front panel for opening/closing the second air inlet.

13. The air conditioner of claim 10, wherein the cabinet further comprises a third air inlet.

14. An air conditioner comprising:

a cabinet having a first air inlet and a second air inlet and discharging purified air; and a filter unit including:

a filter case having a first air outlet for discharging air to the first air inlet and a second air outlet for discharging air to a room, both formed therein and provided at an outside of the cabinet;

a first filter accommodated in the filter case and cleaning the air drawn therein; and an airflow controller for controlling airflow so as to selectively discharge the air purified by the first filter to either the first air outlet or the second air outlet.

15. The air conditioner of claim 14, wherein the airflow controller comprises a damper having an end rotatably provided at the filter case and selectively blocking the air flowing to the first air outlet or to the second air outlet.

16. The air conditioner of claim 15, wherein the filter case further comprises a rotation guide for guiding the rotation of the damper.

17. The air conditioner of claim 16, wherein the rotation guide comprises: a guide projection provided at a side on an edge of the damper; and a guide recess formed in an arc shape on an inner wall of the filter case so as to guide the guide projection.

18. The air conditioner of claim 14, wherein the first air inlet is provided on an upper surface of the cabinet and the second air inlet is provided on a front surface of the cabinet.

19. The air conditioner of claim 18, wherein the cabinet further comprises a front panel being rotated for opening/closing the second air inlet.

* * * * *